US009779897B2

(12) United States Patent
Shinohara et al.

(10) Patent No.: US 9,779,897 B2
(45) Date of Patent: Oct. 3, 2017

(54) SWITCH

(71) Applicant: OMRON Corporation, Kyoto-shi, Kyoto (JP)

(72) Inventors: Kenji Shinohara, Nagaokakyo (JP); Kenji Takahama, Okayama (JP); Naoki Torikai, Kurayoshi (JP); Hiromitsu Kokabu, Okayama (JP); Katsutoshi Kondo, Nagoya (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/113,597

(22) PCT Filed: Nov. 26, 2014

(86) PCT No.: PCT/JP2014/081270

§ 371 (c)(1),
(2) Date: Jul. 22, 2016

(87) PCT Pub. No.: WO2015/129113

PCT Pub. Date: Sep. 3, 2015

(65) Prior Publication Data

US 2017/0011872 A1 Jan. 12, 2017

(30) Foreign Application Priority Data

Feb. 28, 2014 (JP) ..... 2014-038845

(51) Int. Cl.
*H01H 21/02* (2006.01)
*H01H 3/32* (2006.01)
(Continued)

(52) U.S. Cl.
CPC ..... *H01H 21/02* (2013.01); *H01H 3/32* (2013.01); *H01H 3/46* (2013.01); *H01H 2013/525* (2013.01)

(58) Field of Classification Search
CPC H01H 21/02; H01H 3/32; H01H 3/46; H01H 2013/525; H01H 21/14; H01H 1/36;
(Continued)

(56) References Cited

U.S. PATENT DOCUMENTS 7,772,508 B2 * 8/2010 Kiyono ..... H01H 1/242 200/16 D
2015/0021150 A1 * 1/2015 Arihara ..... H01H 1/44 200/252
2015/0047956 A1 * 2/2015 Arihara ..... H01H 1/242 200/260

FOREIGN PATENT DOCUMENTS

CN 101106031 A 1/2008
JP S63-20335 U 2/1988

OTHER PUBLICATIONS

The Chinese office action letter dated May 4, 2017 in the counterpart Chinese patent application.

* cited by examiner

*Primary Examiner* — Edwin A. Leon
(74) *Attorney, Agent, or Firm* — Metrolexis Law Group, PLLC

(57) ABSTRACT

The switch includes the base, a plurality of the fixed contact terminals, the sliding body, the operation lever, the coil spring, and the cover. From above the base, the fixed contact terminals, the sliding body, the operation lever, and the coil spring are mounted to the base, and the sliding body is pressed against the operation lever to position the operation lever. The cover is mounted to the base from above so as to press the operation lever by the pressing portion of the cover and cause the operation lever to rotate to an initial position.

7 Claims, 13 Drawing Sheets

(51) Int. Cl.
*H01H 3/46* (2006.01)
*H01H 13/52* (2006.01)

(58) Field of Classification Search
CPC .... H01H 21/12; H01H 21/36; H01H 2235/01; H01H 2205/002; H01H 1/242; H01H 1/40; H01H 21/24; H01H 3/42; H01H 1/44; H01H 9/02; H01H 2203/036; H01H 3/04; H01H 21/28
USPC ..... 200/252, 16 R, 16 A, 16 B, 16 C, 16 D, 200/260, 553, 557–564, 332, 335–336, 200/339
See application file for complete search history.

SWITCH

TECHNICAL FIELD

The present invention relates to a switch, and particularly relates to a switch of high productivity.

BACKGROUND ART

Conventionally, as a switch, there is a one described in JP 63-20335, for example. In this switch, there is provided a movable body 27 that moves above a common terminal 11 and first and second terminals 12 and 13, the common terminal 11 and the first and second terminals 12 and 13 being formed on the substrate 17. The movable body 27 is moved by operating a lever 32, and a conductive state is switched between the first and second terminals 12 and 13.

PRIOR ART DOCUMENT

Patent Document

Patent Document 1: JP 63-20335

SUMMARY OF THE INVENTION

Problems to be Solved by the Invention

However, in the conventional switch, the movable body 27 is mounted to the substrate 17 from above, with the common terminal 11 and the first and second terminals 12 and 13 press-fitted to the substrate 17 from below. The substrate 17 is inserted to a case 25 from the opening formed on one side surface of the case 25, and is disposed at a predetermined position inside the case. After other parts including a lever 32 are disposed at predetermined positions inside the case 25 through the opening, the assembling is finished by blocking the opening. Thus, in the conventional switch, parts need to be mounted from multiple directions; therefore, assembling takes time, and particularly, the parts tend to fall off in the middle of the assembling. Consequently, productivity has been low.

In view of the above problems, an object of the present invention is to provide a switch of easy assembling and of high productivity.

Means for Solving the Problem

In order to solve the above problems, a switch according to the present invention includes a base, a plurality of fixed contact terminals of which fixed contacts are stretched at an interval so as to form at least one row, on an upper surface of the base, a sliding body having a movable touch piece for making adjacent ones of the fixed contacts conductive, and slidably disposed along the row of the fixed contact terminals, on an upper surface of the base, an operation lever turnably supported on the upper surface of the base, and pressing the sliding body to cause the sliding body to slide, a coil spring assembled to the sliding body, and biasing the sliding body to return toward the operation lever when the sliding body is moved by the operation lever, and a cover having an operation hole for operating the operation lever and a pressing portion for pressing the operation lever, and configured to cover the base. The fixed contact terminal, the sliding body, the operation lever, and the coil spring are mounted to the base from above the base, and the sliding body is pressed against the operation lever to position the operation lever. The cover is mounted to the base from above so as to press the operation lever by the pressing portion of the cover and cause the operation lever to rotate to an initial position.

Effect of the Invention

According to the switch of the present invention, because each part can be mounted to the base in one direction, that is, from above the base, the switch can be easily assembled. Therefore, a switch of easy automated production and of high productivity, for example, can be obtained.

As an embodiment of the present invention, the operation lever has a lever body turnably supported on the base, and a pressing arm extending so as to form a certain angle with the lever body and pressing the sliding body to cause the sliding body to slide. The cover may be mounted to the base from above so as to press the pressing arm with the pressing portion.

According to the embodiment, because the pressing portion forms a certain angle with the lever body, the pressing arm can be securely pressed by the pressing portion when the cover is mounted from above the base.

As an embodiment of the present invention, the operation lever may be configured to have, on at least a part of the surrounding of a turning axis of the lever body, a curved surface on which the operation lever can turn by keeping a pressure contact with the sliding body.

According to the embodiment, because the operation lever has a curved surface on which the operation lever can turn by keeping a pressure contact state with the sliding body, the cover can be mounted to the base by keeping the sliding body at a desired position. Accordingly, a switch of easy assembling can be obtained.

As an embodiment of the present invention, the sliding body may be configured to have a pressing projection including a tapered surface which becomes in pressure contact when the tapered surface is pressed against the operation lever.

According to the embodiment, because the pressing projection has a tapered surface, the operation lever can securely turn by keeping the pressure contact state with the sliding body. Accordingly, a switch of easy assembling can be obtained.

As an embodiment of the present invention, a coil spring housing for housing the coil spring is provided on an upper part of the sliding body. The coil spring housing may be configured to have an opened box shape.

According to the embodiment, because the coil spring can be mounted from above the base, a switch of easy assembling can be obtained.

As an embodiment of the present invention, a supporting rib may be protruded on an inner surface of the cover, the supporting rib being brought into pressure contact with one end of the coil spring to compress the coil spring, for obtaining a returning force for causing the sliding body to return toward the operation lever.

According to the embodiment, a high returning force for causing the sliding body to return to a returning position can be obtained.

As an embodiment of the present invention, the supporting rib and the coil spring may be brought into contact with each other when, by mounting the cover to the base from above, the lower surface of the supporting rib is at a position above the upper surface of the coil spring by ⅓ or more of the diameter of the coil spring.

According to the embodiment, when the cover is mounted to the base, it is possible to avoid applying a large force in other than a compression direction, to the coil spring housed in the coil spring housing. Therefore, the occurrence of falling off of the coil spring from the coil spring housing, floating, or biting can be prevented.

MODE FOR CARRYING OUT THE INVENTION

Hereinafter, a switch according to an embodiment of the present invention will be described with reference to the accompanying drawings of FIG. 1 to FIG. 22.

Figure 3:
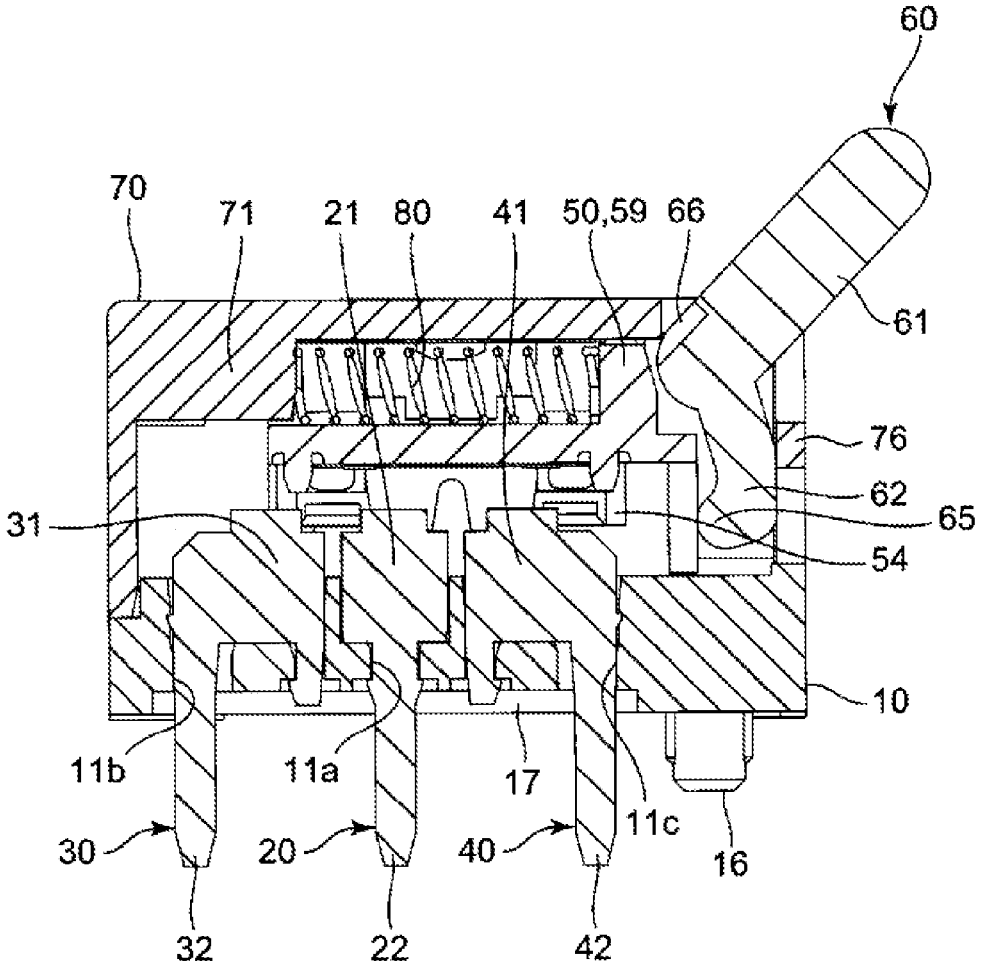
FIG. 3 is a longitudinal sectional view of the switch in FIG. 1.
Figure 4:
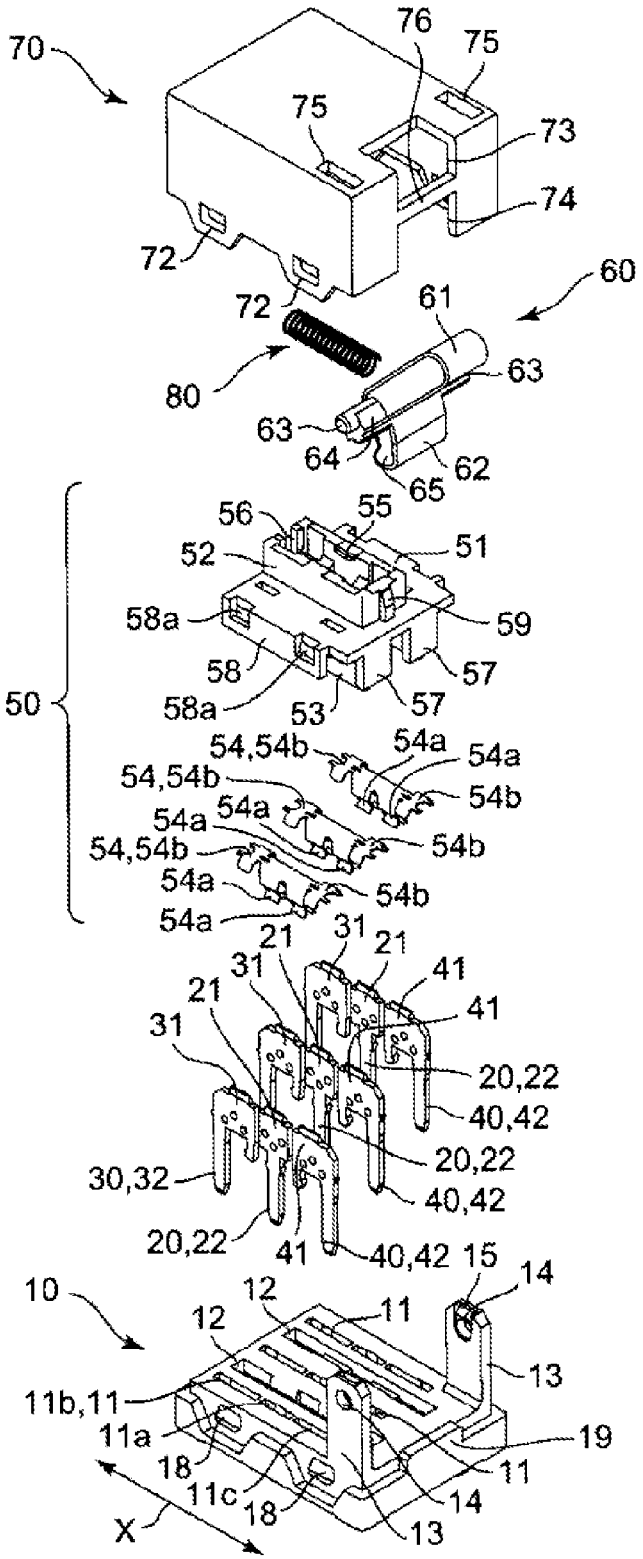
FIG. 4 is an exploded perspective view of the switch in FIG. 1.
Figure 5:
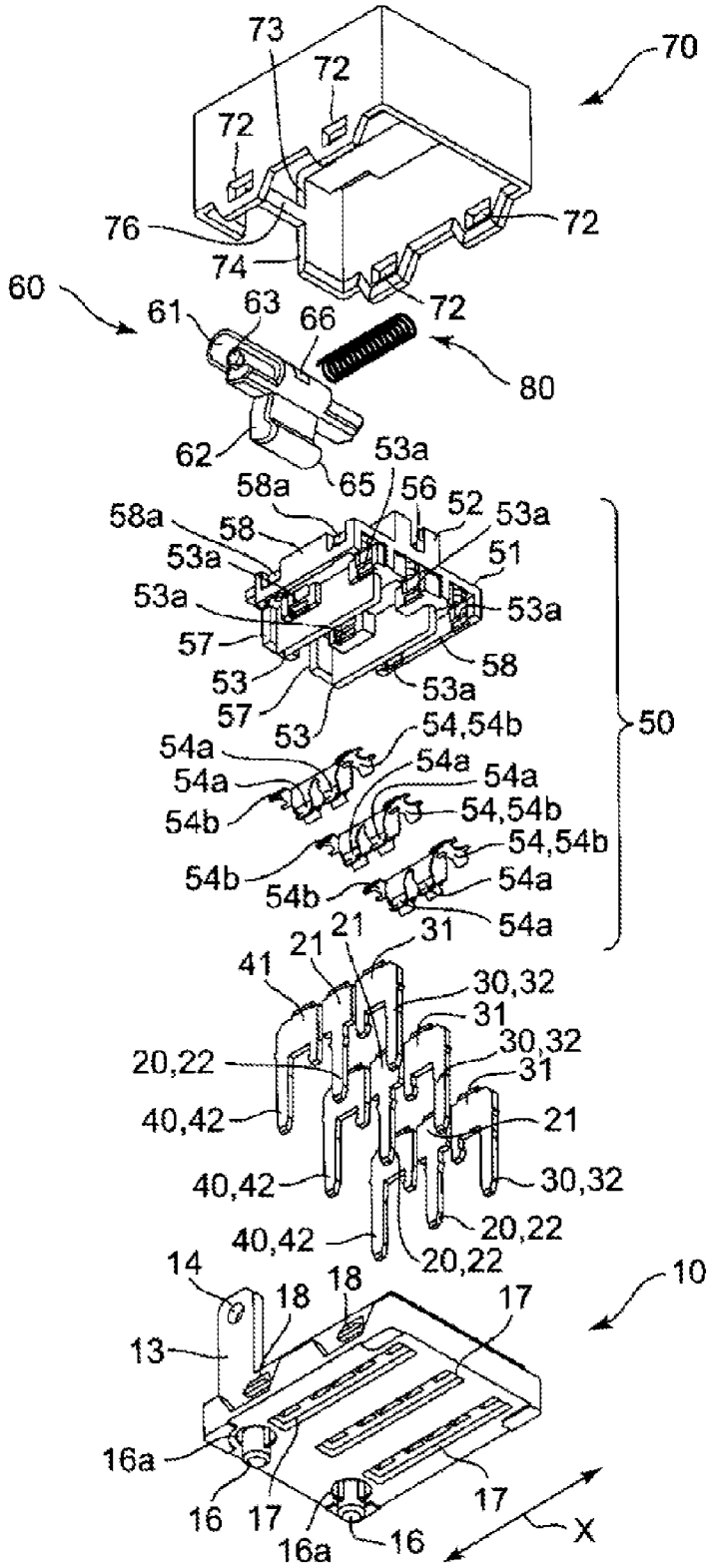
FIG. 5 is an exploded perspective view of the switch in FIG. 2.

As illustrated in FIG. 4 and FIG. 5, the switch of the embodiment includes a base 10, a sliding body 50 provided on the base 10, and a cover 70 provided to cover the base 10. In the base 10, there are provided a common fixed contact terminal 20 and first and second fixed contact terminals 30 and 40 that are three sets, and an operation lever 60. Furthermore, as illustrated in FIG. 3, a coil spring 80 is provided in the sliding body 50.

As illustrated in FIG. 4, the base 10 is in a plane rectangular shape, and has, on the upper surface of the base 10, terminal hole rows 11 for press-fitting the common fixed contact terminals 20 and the first and second fixed contact terminals 30 and 40, guide grooves 12 for guiding the sliding body 50, and a pair of supports 13 for supporting the operation lever 60.

As illustrated in FIG. 3, three rows of the terminal hole rows 11 are provided, at an equal interval, in parallel with opposite sides of the base 10. Each of the terminal hole rows 11 is constituted of a common terminal hole 11*a* for press-fitting the common fixed contact terminal 20, a first terminal hole 11*b* for press-fitting the first fixed contact terminal 30, and a second terminal hole 11*c* for press-fitting the second fixed contact terminal 40. The common terminal hole 11*a* and the first and second terminal holes 11*b* and 11*c* are disposed so that the common terminal hole 11*a* is positioned between the first and second terminal holes 11*b* and 11*c*. Therefore, the common fixed contact terminal 20 and the first and second fixed contact terminals 30 and 40 are configured to be aligned in a row when the common fixed contact terminal 20 and the first and second fixed contact terminals 30 and 40 are press-fitted. The first and second terminal holes 11*b* and 11*c* are symmetrically disposed, with the common terminal hole 11*a* as a center.

As illustrated in FIG. 4, two guide grooves 12 are provided, on the upper surface of the base 10, and are disposed between the adjacent terminal hole rows so as to be parallel to the terminal hole rows 11. Along an extending direction X of the guide groove 12, the sliding body 50 is configured to move by sliding. That is, the extending direction X of the guide groove 12 becomes a sliding direction X of the sliding body 50.

As illustrated in FIG. 4, the pair of supports 13 are each in a plate shape, with chamfered corners at a front end, and are formed in projection to face each other on upper-surface edges of opposed sides of the base 10. As illustrated in FIG. 4, each support 13 has a supporting hole 14 for turnably supporting the operation lever 60, and a mounting groove 15 communicating from the front end to the supporting hole 14 on an inward surface of the support 13. A bottom surface of the mounting groove 15 is a tapered surface, with a groove becoming gradually shallow from the front end of the support 13 toward the supporting hole 14. Therefore, the operation lever 60 can be easily mounted and is not easily released.

A positioning projection 19 is formed in projection on an upper-surface edge of the base 10 positioned between the pair of supports 13. Furthermore, as illustrated in FIG. 4, unevenness in accordance with the shape of the cover 70 is provided on outer-peripheral edges of the upper surface of the base 10.

Furthermore, as illustrated in FIG. 5, the base 10 has a pair of positioning protrusions 16 for positioning the switch to the substrate and the like, on each back side of the support 13, out of the bottom surface of the base 10. Around the positioning protrusions 16, there are provided grooves 16*a* for accumulating shavings that are generated when the positioning protrusions 16 are fitted to the substrate and the like. Furthermore, flux-preventing recesses 17 are arranged on the base part of the terminal hole rows 11 on the bottom surface of the base 10.

Furthermore, as illustrated in FIG. 4 and FIG. 5, the base 10 has two mounting projections 18 on each of side surfaces parallel to the extending direction X of the guide grooves 12 out of the side surfaces of the base 10. By fitting the mounting projections 18 to mounting holes 72 of the cover 70 described later, the cover 70 can be integrated with the base 10.

As illustrated in FIG. 4, each common fixed contact terminal 20 has a common fixed contact 21, on an upper end of the common fixed contact terminal 20, and has a common fixed terminal 22, on a lower end of the common fixed contact 21. The common fixed contact terminal 20 is press-fitted to the common terminal hole 11*a* from above the base 10. The common fixed contact 21 is exposed to the upper surface of the base 10, and the common fixed terminal 22 is stretched from the bottom surface of the base 10. A guiding tapered surface to be used for assembling the sliding body 50 is provided on the upper part of the common fixed contact 21.

As illustrated in FIG. 4, the first and second fixed contact terminals 30 and 40 have first and second fixed contacts 31 and 41, on upper ends of the first and second fixed contact terminals 30 and 40, and have first and second fixed terminals 32 and 42, on lower ends of the first and second fixed contact terminals 30 and 40. The first and second fixed contact terminals 30 and 40 are press-fitted from above the base 10 to the first and second terminal holes 11*b* and 11*c*. The first and second fixed contacts 31 and 41 are exposed to the upper surface of the base 10, and the first and second fixed terminals 32 and 42 are stretched from the bottom surface of the base 10. A guiding tapered surface to be used for assembling the sliding body 50 is provided on each upper part of the first and second fixed contacts, in a similar manner to the common fixed contact 21.

As illustrated in FIG. 4 and FIG. 5, the sliding body 50 is constituted of a body part 51, a coil spring housing 52 for housing the coil spring 80, guide projections 53 inserted to the guide grooves 12 to guide the sliding body 50, and movable touch pieces 54 touching the common fixed contact terminal 20 and one of the first and second fixed contact terminals 30 and 40 to make the touched contact terminals conductive.

As illustrated in FIG. 4, the body part 51 is in a plane rectangular shape, and has holding protrusions 58 for holding the movable touch pieces 54, on side edges parallel to the sliding direction X of the sliding body 50. The holding protrusions 58 are formed in projection to face the guide projections 53, and have, on the base part of the holding protrusions 58, latching holes 58*a* to latch latching portions 54*b* of the movable touch pieces 54 described later. The latching holes 58*a* are disposed on both ends in a longitudinal direction of the holding protrusions 58.

As illustrated in FIG. 4, the coil spring housing 52 is provided at approximately the center of the upper surface of the body part 51, and is in a box shape opened along the sliding direction X of the sliding body 50. On an edge of the upper opening of the coil spring housing 52, a projection 55 for preventing the floating of the coil spring 80 at the assembling time is provided. The coil spring housing 52 has a pressing projection 59 for pressing the operation lever 60, on one end surface in the longitudinal direction of the coil spring housing 52. As illustrated in FIG. 3, the pressing projection 59 has a tapered surface, on an upper side of the front end of the pressing projection 59. On the other end surface in the longitudinal direction of the coil spring housing 52, there is provided a fitting groove 56 to which a supporting rib 71 provided on an inner surface of the cover 70 described later can be fitted.

As illustrated in FIG. 5, the guide projections 53 are in plate shapes, and two guide projections 53 are formed in projection in parallel along the sliding direction X of the sliding body 50, on the bottom surface of the body part 51. The guide projections 53 can be fitted to the guide grooves 12 and are slidable. Each guide projection 53 has a pressing wall 57, on an end in the longitudinal direction of the side where the pressing projection 59 is provided. The pressing walls 57 are configured to be pressed by a pressing arm 62 of the operation lever 60 described later. On both side surfaces of the guide projections 53, there are provided latching portions 53*a* for latching the latching portions 54*b* of the movable touch pieces 54 described later. The latching portions 53*a* face the latching holes 58*a* of the holding protrusions 58.

As illustrated in FIG. 4 and FIG. 5, each movable touch piece 54 is constituted of two movable contacts 54*a*, and latching portions 54*b* of both ends. The movable touch pieces 54 are mounted parallel to each other, between the holding protrusion 58 on the bottom surface of the body part 51 and the guide projection 53, and between the guide projections 53. The movable contacts 54*a* and 54*b* are disposed at the same interval as the interval between the common fixed contact 21 and the first fixed contact 31 (the second fixed contact 41). Therefore, by moving the sliding body 50, conductive states of the common fixed contact terminals 20 and the first and second fixed contact terminals 30 and 40 in the three rows can be switched at the same time.

As illustrated in FIG. 5, each movable contact 54*a* has a shape in which the movable contact 54*a* can touch, at the same time, the common fixed contact terminal 20 and any one of the first and second fixed contact terminals 30 and 40. Furthermore, as illustrated in FIG. 5, the latching portions 54*b* are configured to be latched with the latching holes 58*a* of the holding protrusions 58 and the latching portions 53*a* of the guide projections 53 facing the latching holes 58*a* so that the movable touch pieces 54 can be held on the bottom surface side of the body part 51.

As illustrated in FIG. 3, the operation lever 60 is in approximately a dog-leg shape in the sectional view, and is constituted of a lever body 61, and a pressing arm 62 extending from one end of the lever body 61.

As illustrated in FIG. 3, the lever body 61 is in a plate shape, and has a curved surface along a turning direction of the operation lever 60, on both ends in the longitudinal direction. Furthermore, as illustrated in FIG. 5, the lever body 61 has a shaft 63 for turnably mounting the operation lever 60 to the support 13 of the base 10, on one end of the lever body 61, and a pressing groove 66 for pressing the coil spring housing 52 of the sliding body 50 against the lever body 61. That is, the operation lever 60 turns using the shaft 63 of the lever body 61 as a turning axis, and has a curved surface along the turning direction of the operation lever 60 around the shaft 63 (around the turning axis).

As illustrated in FIG. 4, the shaft 63 is in approximately a cylindrical shape and has a pressing plane 64, on a base-part side of the shaft 63, and is formed in projection to be fitted to the supporting hole 14 of the base 10, on both side surfaces of the lever body 61. The pressing plane 64 is configured to press the operation lever 60 at the time of mounting the operation lever 60 to the support 13. Therefore, by elastically deforming the support 13 of the base 10, the shaft 63 can be easily fitted to the supporting hole 14 of the support 13.

Furthermore, as illustrated in FIG. 5, the pressing groove 66 is disposed, on one end of the lever body 61, at a position where the pressing groove 66 can be contacted to the pressing projection 59.

The pressing arm 62 extends from the lever body 61 to form a certain angle with the lever body 61, and has a projection 65 on a front end of the lever body 61, for pressing the pressing walls 57 of the sliding body 50.

As illustrated in FIG. 4 and FIG. 5, the cover 70 is in a box shape to enable the cover 70 to be mounted to the base 10, and has mounting holes 72 for mounting the cover 70 to the base 10, an operation hole 73 for operating the operation lever 60, and supporting holes 75 for reinforcing the support 13 of the base 10.

The mounting holes 72 are disposed on the edges of openings at both sides of the cover 70, and are provided to be fitted to the mounting projections 18 of the base 10.

The operation hole 73 is disposed on an upper-surface corner of the cover 70, and is provided so that parts of the upper surface and the side surface of the cover 70 are opened. On a lower side of the operation hole 73, a notch 74 is provided, and the positioning projection 19 of the base 10 can be fitted to the notch 74. Furthermore, a pressing portion 76 is provided between the operation hole 73 and the notch 74.

Figure 1:
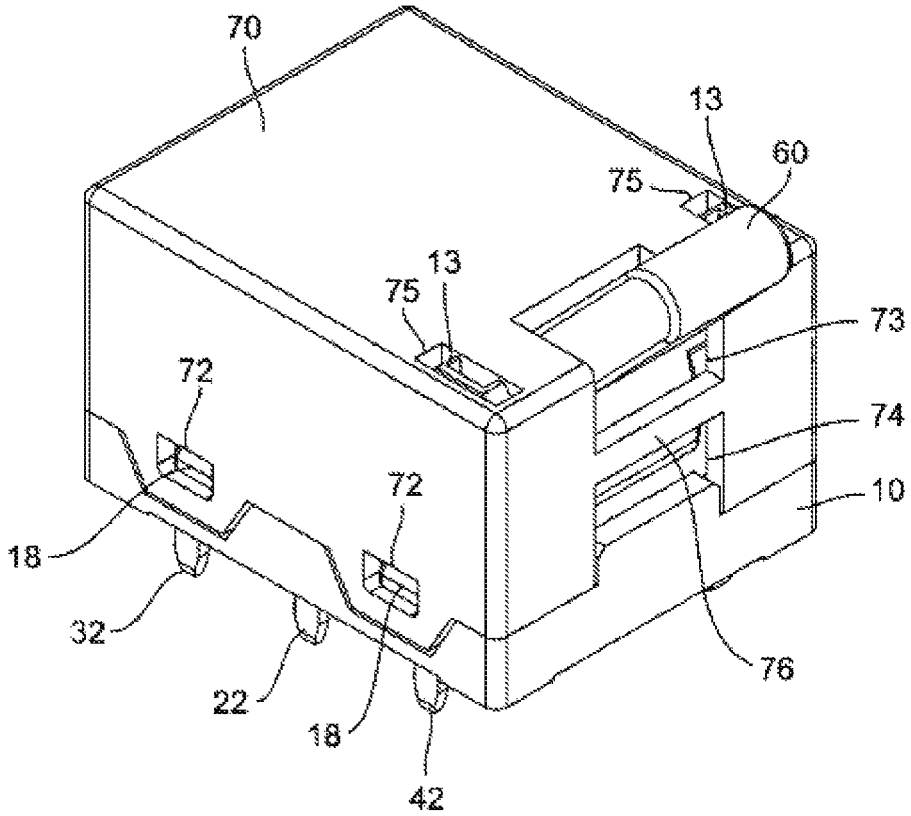
FIG. 1 is a perspective view illustrating a switch according to an embodiment of the present invention.
Figure 2:
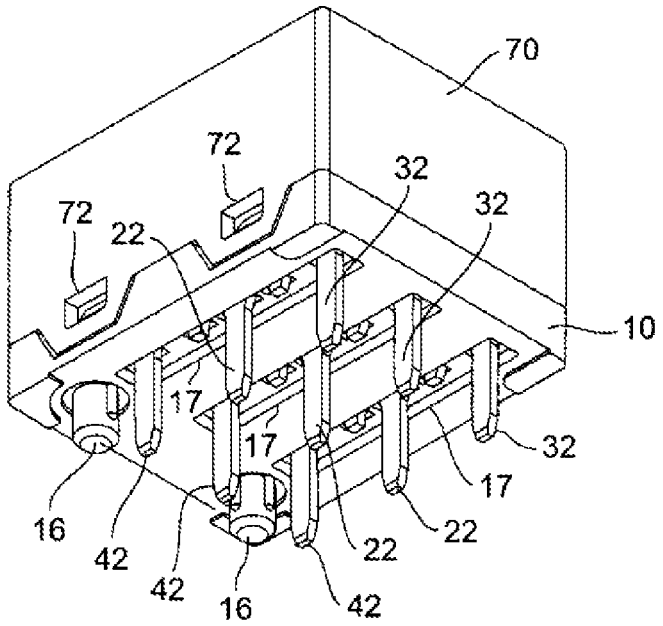
FIG. 2 is a perspective view of the switch in FIG. 1 looked at from a different direction.

The supporting holes 75 are disposed on both sides of the operation hole 73 on the upper surface of the cover 70. As illustrated in FIG. 1, the supporting holes 75 are configured to support the supports 13 such that the upper ends of the supports 13 passes through the supporting holes 75, when the cover 70 is mounted to the base 10. Therefore, in the assembled switch, because the supports 13 can be reinforced, the positioning accuracy of the operation lever 60 can be enhanced.

As illustrated in FIG. 3, a supporting rib 71 is provided on the inner surface of the cover 70. The supporting rib 71 is disposed at the center in a lateral direction of the side opposite to the operation hole 73 of the cover 70, and is fitted to the fitting groove 56 of the coil spring housing 52 of the sliding body 50 when the switch is assembled. Reinforcing ribs not illustrated are provided on both sides of the supporting rib 71.

The coil spring 80 has a natural length slightly larger than the length in the longitudinal direction of the coil spring housing 52 of the sliding body 50. When the switch is assembled, the coil spring 80 is pressed by the supporting rib 71 inside the cover 70, and is compressed to bias the sliding body 50 toward the operation lever 60.

Next, an assembling method of the switch of the above configuration will be described with reference to FIG. 6 to FIG. 17.

Figure 6:
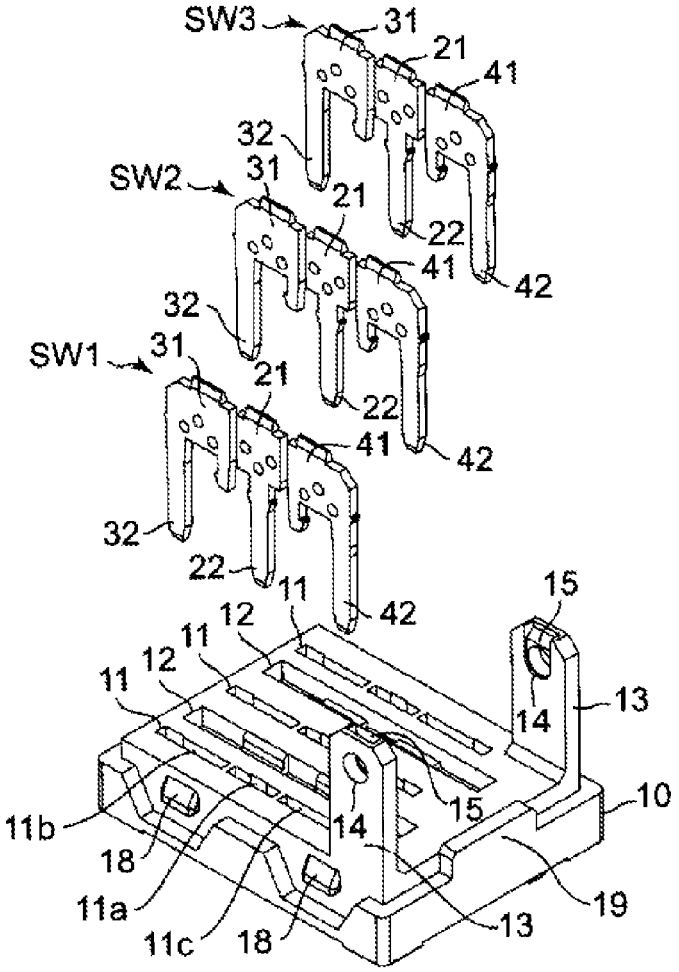
FIG. 6 is a perspective view for explaining an assembling method of the switch in FIG. 1.
Figure 7:
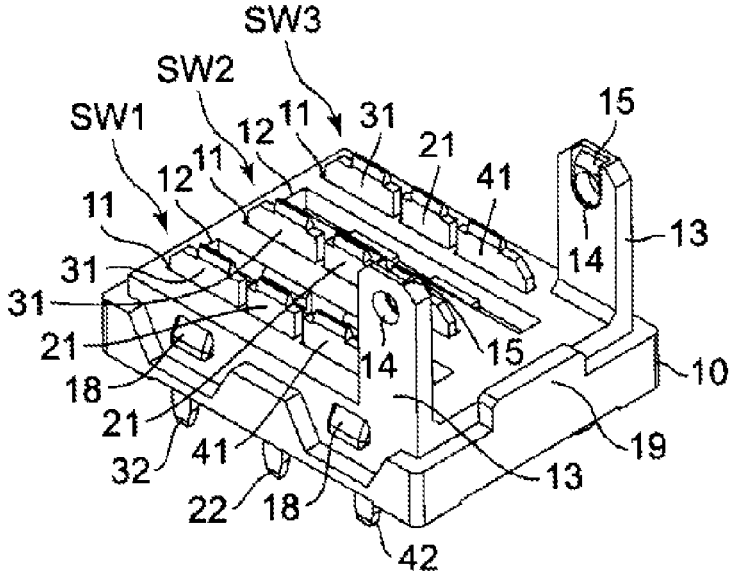
FIG. 7 is a perspective view for explaining an assembling method of the switch in FIG. 1 subsequent to FIG. 6.

First, as illustrated in FIG. 6, switch parts SW1, SW2, and SW3 that are three sets are formed, by press-fitting, from the upper surface of the base 10, the common fixed contact terminals 20 and the first and second fixed contact terminals 30 and 40 to the terminal hole rows 11 of the base 10. At this time, as illustrated in FIG. 7, the common fixed contacts 21 and the first and second fixed contacts 31 and 41 are exposed from the upper surface of the base 10, and the common fixed terminals 22 and the first and second fixed terminals 32 42 are stretched from the bottom surface of the base 10.

The common fixed contact terminals 20 and the first and second fixed contact terminals 30 and 40 may be mounted to the base 10 by insertion when possible, instead of by press-fitting.

Figure 8:
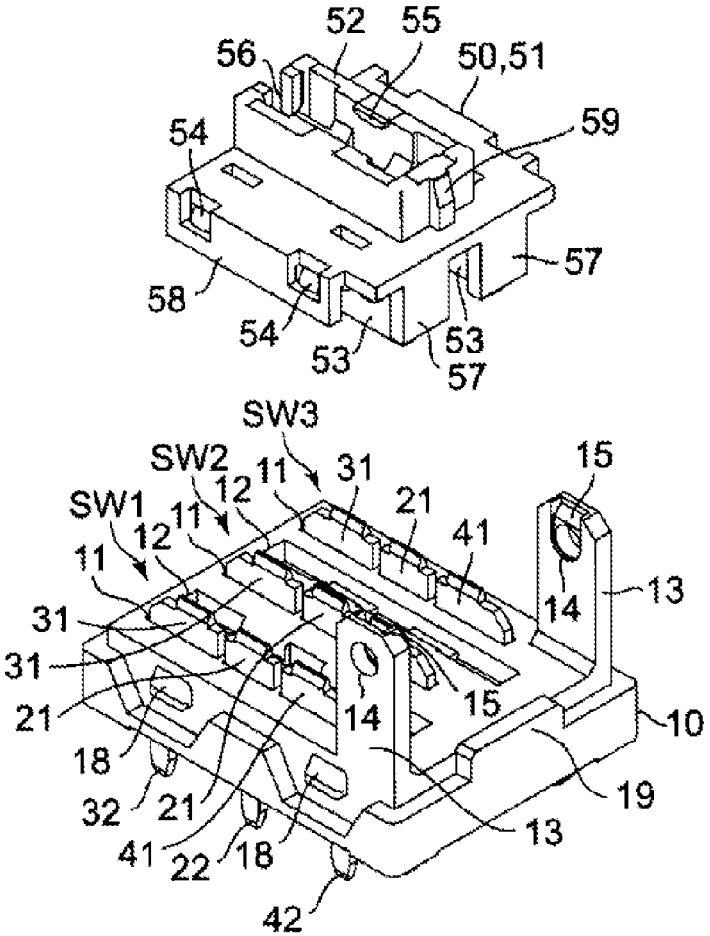
FIG. 8 is a perspective view for explaining an assembling method of the switch in FIG. 1 subsequent to FIG. 7.
Figure 9:
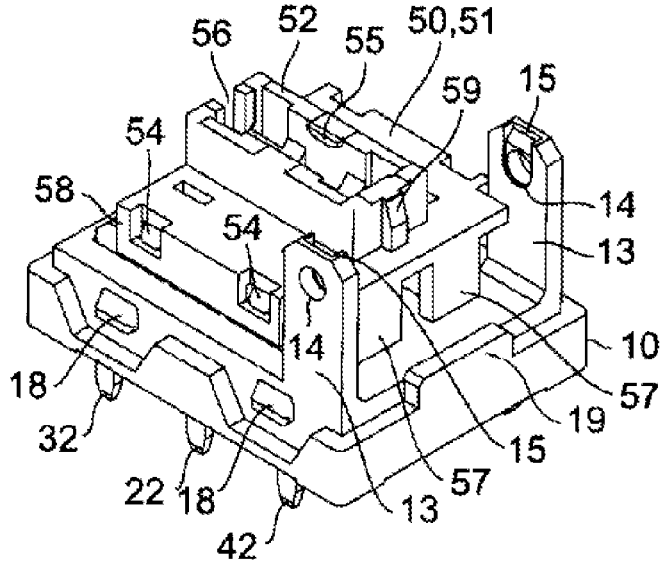
FIG. 9 is a perspective view for explaining an assembling method of the switch in FIG. 1 subsequent to FIG. 8.

After the common fixed contact terminals 20 and the first and second fixed contact terminals 30 and 40 are press-fitted, the sliding body 50 installed in advance with the movable touch pieces 54 is mounted onto the switch parts SW1, SW2, and SW3 that are three sets, as illustrated in FIG. 8 and FIG. 9. At this time, by inserting the guide projections 53 of the sliding body 50 to the guide grooves 12 of the base 10, the movable touch pieces 54 of the sliding body 50 are disposed to touch the common fixed contacts 21 and the first and second fixed contacts 31 and 41.

Figure 10:
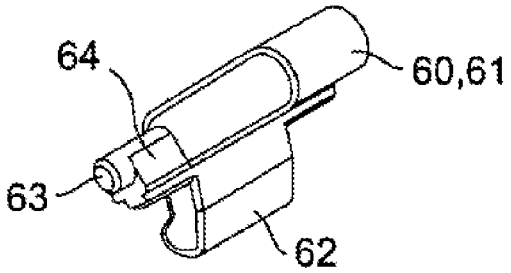
FIG. 10 is a perspective view for explaining an assembling method of the switch in FIG. 1 subsequent to FIG. 9.
Figure 10:
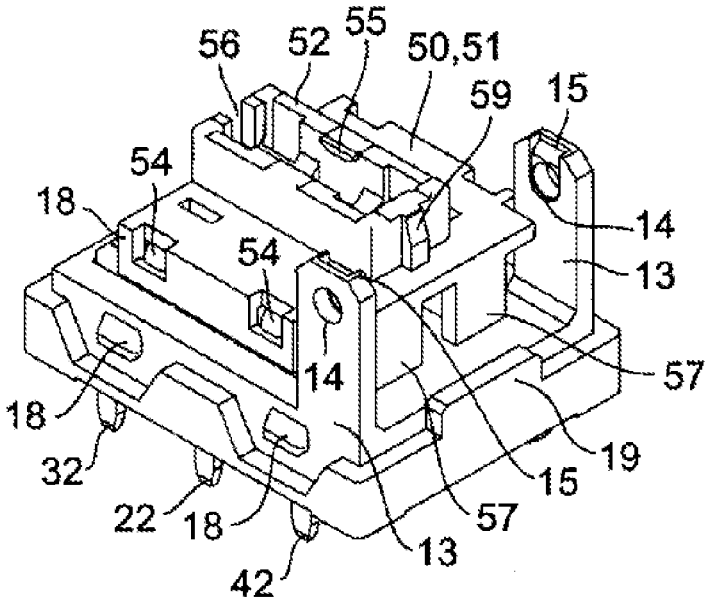
Figure 11:
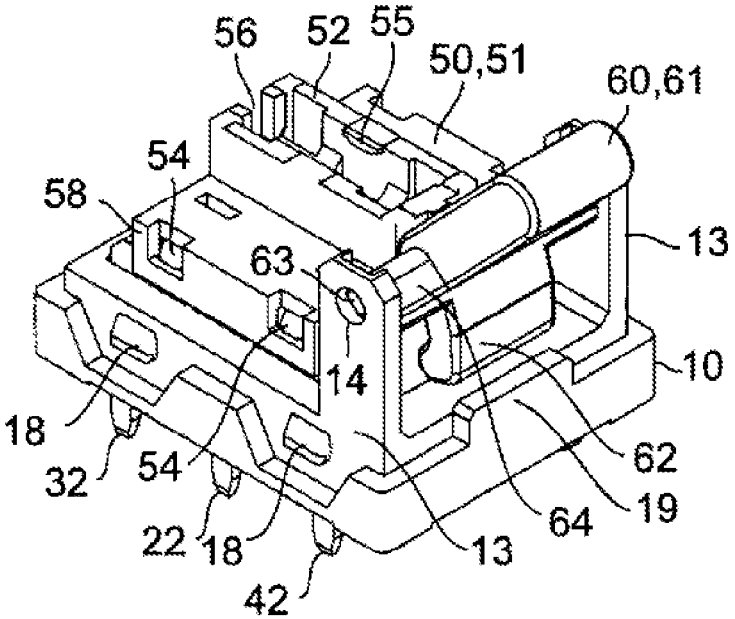
FIG. 11 is a perspective view for explaining an assembling method of the switch in FIG. 1 subsequent to FIG. 10.

After mounting the sliding body 50, the operation lever 60 is mounted to the supports 13 of the base 10, as illustrated in FIG. 10 and FIG. 11. The operation lever 60 is mounted by pressing a tool to the pressing plane 64, for example.

As described above, by mounting the operation lever 60 to the base 10, positioning accuracy of the operation lever 60 can be enhanced more than the positioning accuracy when the operation lever is mounted to the cover 70. Therefore, the assembling accuracy of the switch can be enhanced, and variations in the operation characteristics can be reduced.

Figure 12:
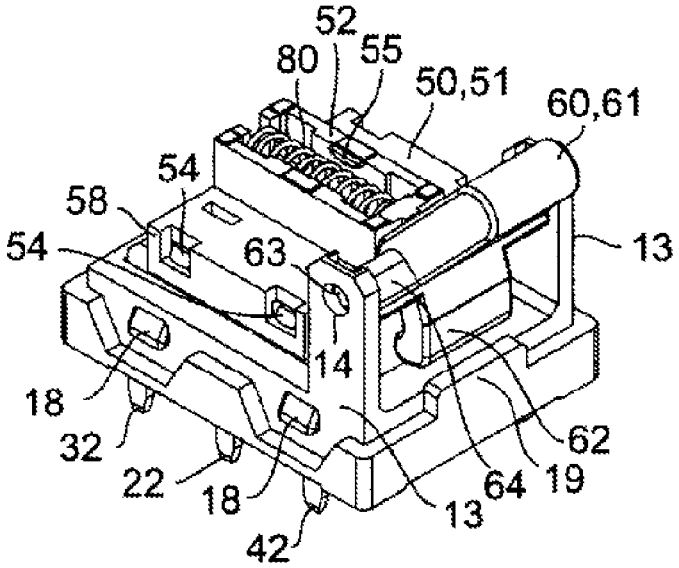
FIG. 12 is a perspective view for explaining an assembling method of the switch in FIG. 1 subsequent to FIG. 11.

Next, as illustrated in FIG. 12, the coil spring 80 is housed inside the coil spring housing 52, by inserting the coil spring 80 from the upper opening of the coil spring housing 52 of the sliding body 50. At this time, the projection 55 provided on the upper opening of the coil spring housing 52 prevents the coil spring 80 from jumping out of the coil spring housing 52 during the assembling.

The projection 55 is for temporarily stopping the coil spring 80 during the assembling, and is provided to prevent the projection 55 from touching the coil spring 80 in the assembled switch. Therefore, in the assembled switch, because the projection 55 does not impede the operation of the coil spring 80, a satisfactory operation of the coil spring 80 can be ensured.

Figure 13:
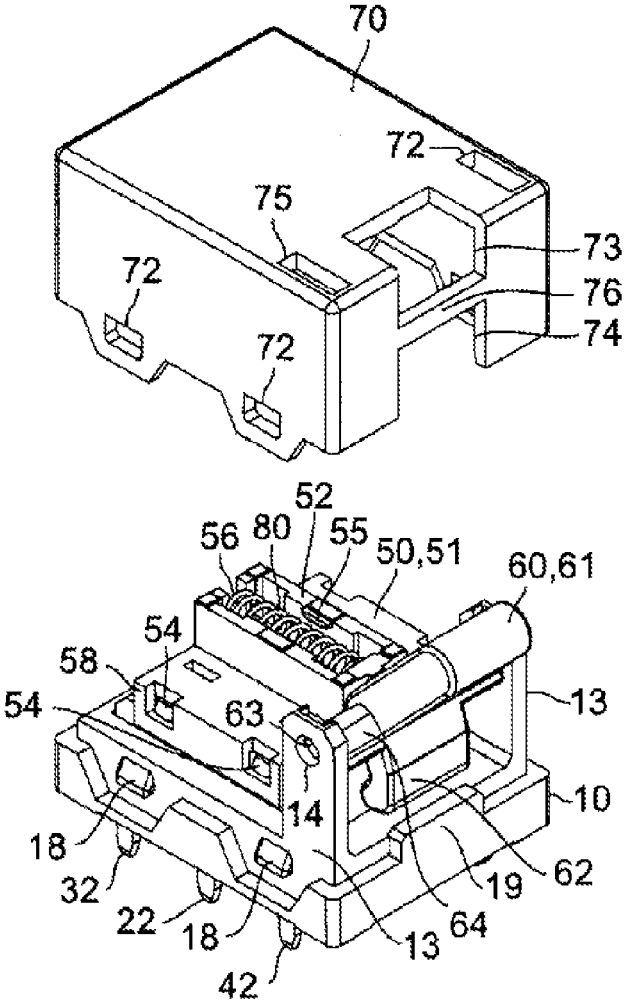
FIG. 13 is a perspective view for explaining an assembling method of the switch in FIG. 1 subsequent to FIG. 12.

Finally, as illustrated in FIG. 13, the cover 70 is mounted on the base 10.

Figure 14:
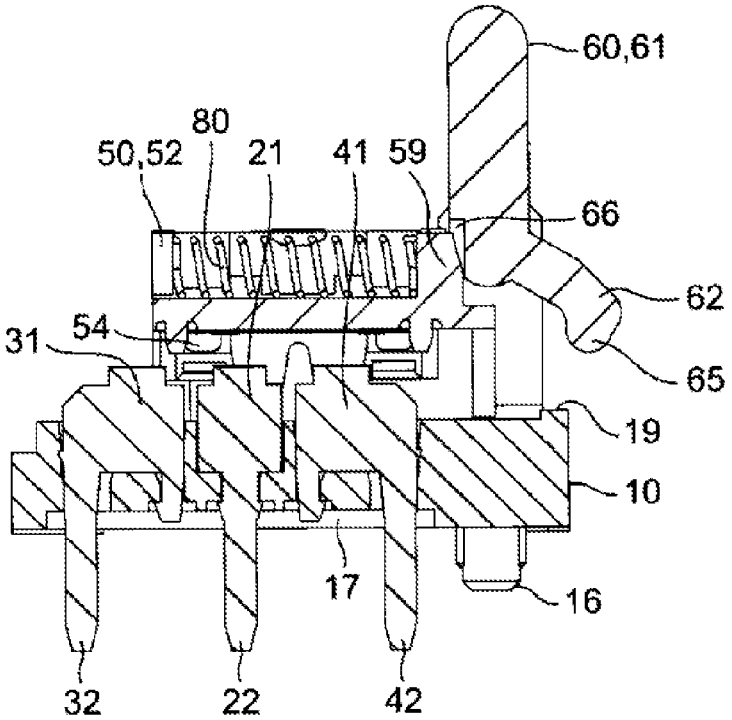
FIG. 14 is a longitudinal sectional view for explaining in more detail the assembled state of the switch illustrated in FIG. 13.

At the time of mounting the cover 70 to the base 10, first, as illustrated in FIG. 14, the pressing projection 59 of the sliding body 50 is pressed against the pressing groove 66 of the operation lever 60. Then, the operation lever 60 rotates to a position where the lever body 61 of the operation lever 60 becomes perpendicular to the base 10 so that the operation lever 60 is positioned.

Figure 15:
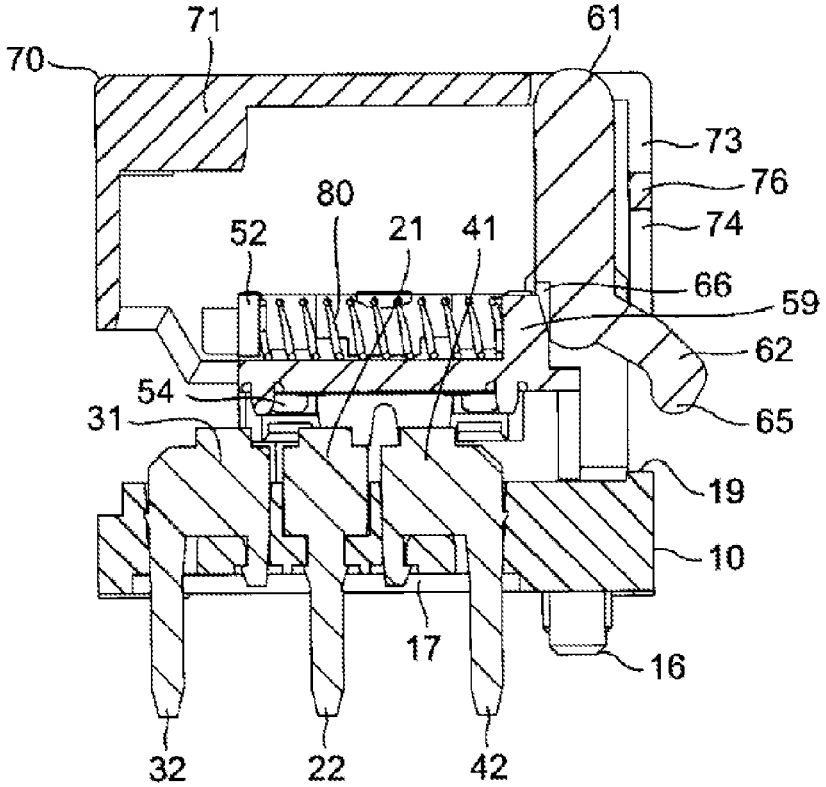
FIG. 15 is a longitudinal sectional view for explaining in more detail the assembled state of the switch illustrated in FIG. 14 subsequent to FIG. 14.

Then, as illustrated in FIG. 15, the cover 70 is brought close to the base 10 so that the lever body 61 of the operation lever 60 passes through the operation hole 73 of the cover 70 from above the base 10 and the pressing arm 62 of the operation lever 60 passes through the notch 74 of the cover 70. At this time, because the operation lever 60 is positioned where the lever body 61 of the operation lever 60 becomes perpendicular to the base 10, the cover 70 can be brought close to the base 10 so that the direction of the cover 70 is not changed and the lever body 61 does not touch the cover 70.

Figure 16:
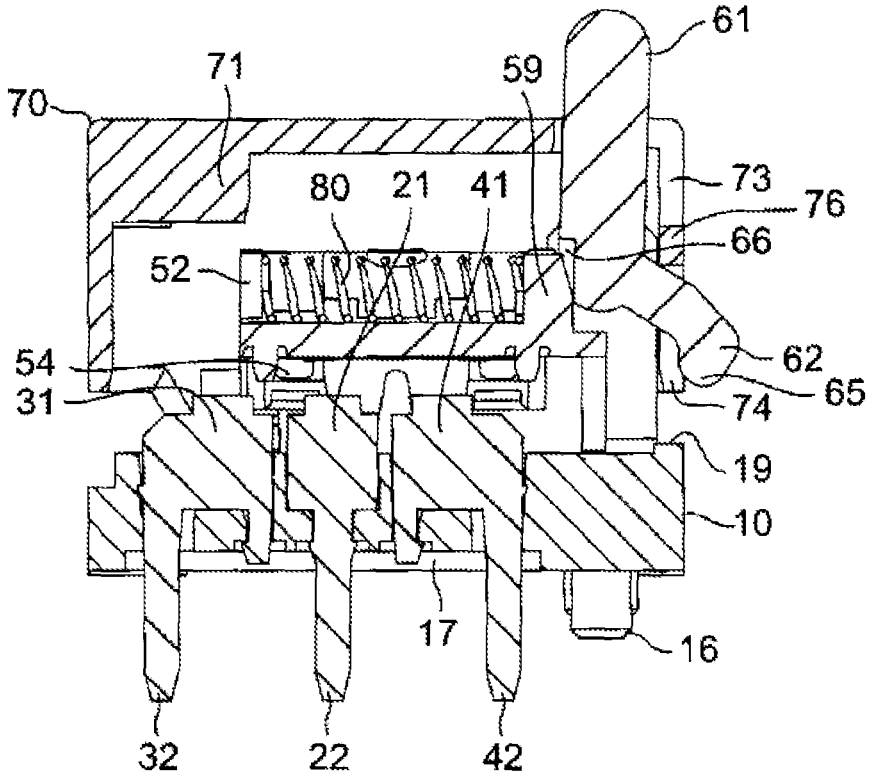
FIG. 16 is a longitudinal sectional view for explaining in more detail the assembled state of the switch illustrated in FIG. 14 subsequent to FIG. 15.
Figure 17:
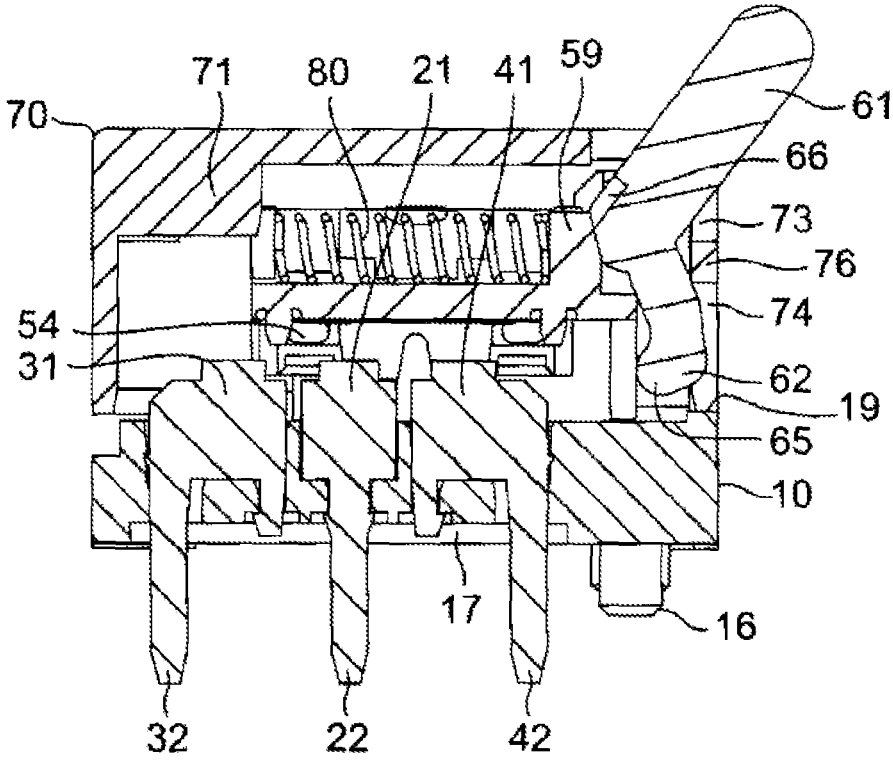
FIG. 17 is a longitudinal sectional view for explaining in more detail the assembled state of the switch illustrated in FIG. 14 subsequent to FIG. 16.

As illustrated in FIG. 16, when the cover 70 is brought close to the base 10, the upper part of the pressing arm 62 of the operation lever 60 touches the pressing portion 76 of the cover 70. When the cover 70 is further brought closer to the base 10, the pressing portion 76 presses the pressing arm 62 to cause the operation lever 60 to rotate, as illustrated in FIG. 17. Accordingly, the pressing arm 62 moves to the inside of the cover 70, and the projection 65 of the pressing arm 62 touches the pressing wall 57 of the sliding body 50.

At this time, because the operation lever 60 has a curved surface along the turning direction at the end of the shaft 63 side, and because the pressing projection 59 of the sliding body 50 has a tapered surface, the operation lever 60 can securely turn by keeping the pressure contact state with the sliding body 50. That is, the sliding body 50 is seldom displaced to a sliding direction (a lateral direction in FIG. 17) by the turning of the operation lever 60.

At this stage, the supporting rib 71 of the cover 70 is not brought into contact with the coil spring 80.

Thereafter, when the cover 70 is further brought closer to the base 10, the pressing wall 57 of the sliding body 50 is pressed by the projection 65 of the pressing arm 62, and the sliding body 50 slides. At this time, the supporting rib 71 can be brought into contact with the coil spring 80 when the lower surface of the supporting rib 71 is positioned above the upper surface of the coil spring 80 by ⅓ or more, preferably ½ or more, of the diameter of the coil spring 80. Accordingly, at the time of mounting the cover 70 to the base, it is possible to avoid applying a large force in other than the compression direction, to the coil spring 80 housed in the coil spring housing 52. Therefore, the occurrence of falling off of the coil spring 80 from the coil spring housing 52, floating, or biting can be prevented.

Then, the mounting hole 72 of the cover 70 is fitted to the mounting projection 18 of the base 10. After the cover 70 is mounted to the base 10, the operation lever 60 is positioned in the state of the switch illustrated in FIG. 3 (at an initial (returning) position at the assembling time). At this time, because the supporting rib 71 is brought into pressure contact with one end of the coil spring 80, the coil spring 80 is housed in the coil spring housing 52 in a slightly compressed state. As described above, because the coil spring 80 is compressed by the supporting rib 71, the returning force for causing the sliding body 50 to return toward the operation lever 60 can be enhanced.

As described above, according to the switch of the above configuration, because each part can be mounted to the base 10 in one direction, that is, from above the base 10, the switch can be easily assembled. Therefore, a switch of easy automated production and of high productivity, for example, can be obtained.

Next, the operation of the switch in the above configuration will be described with reference to FIG. 18 to FIG. 22.

Figure 18:
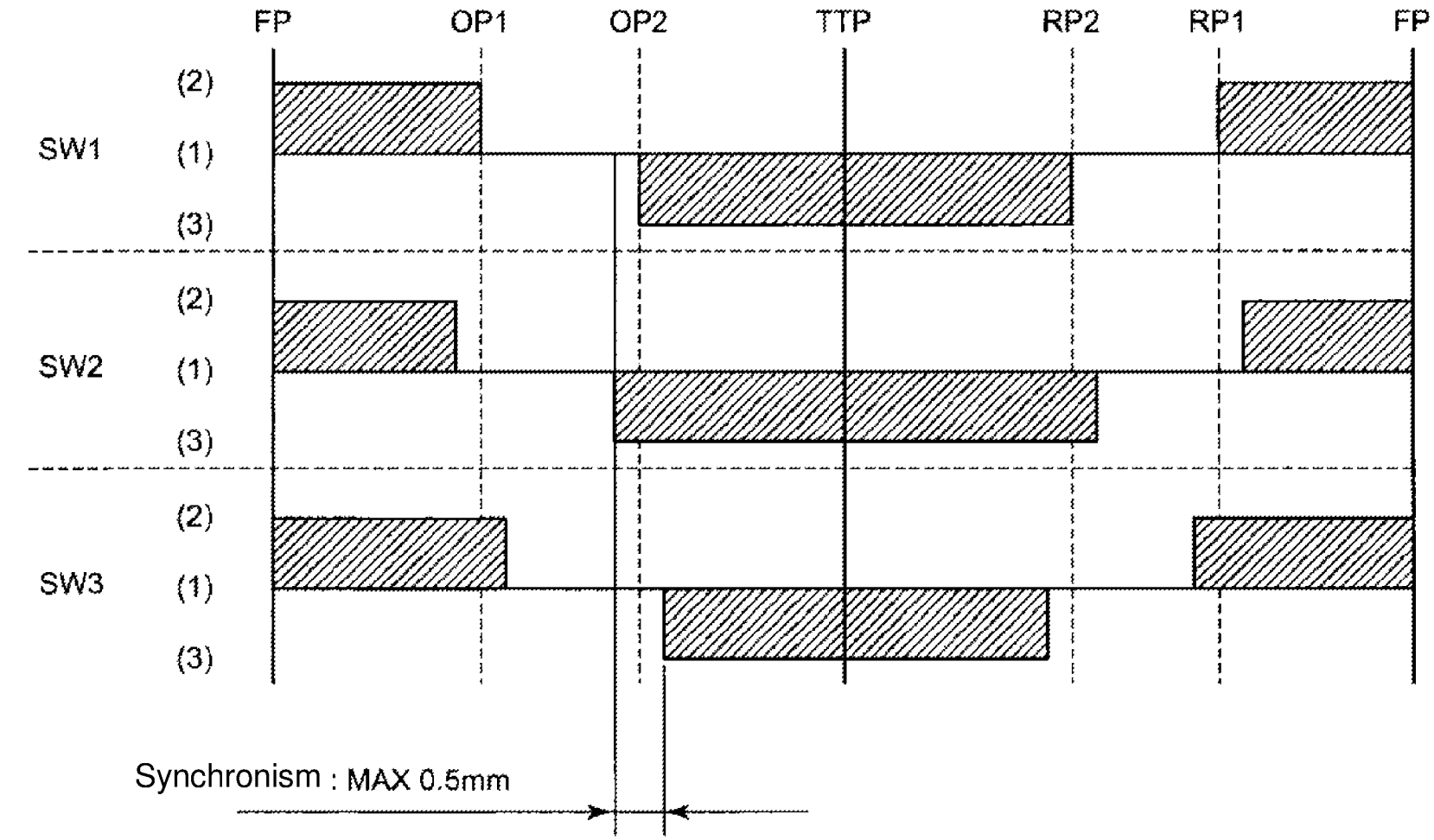
FIG. 18 is a timing chart illustrating ON and OFF of the switch in FIG. 1.

As described above, the switch has the switch parts SW1, SW2, and SW3 that are three sets. As illustrated in FIG. 18, the switch parts SW1, SW2, and SW3 are switched approximately at the same time by the operation lever 60. In FIG. 18, (1) represents the common fixed contact terminal 20, (3) represents the first fixed contact terminal 30, and (2) represents the second fixed contact terminal 40, in the vertical axis. FP in the lateral axis indicates the switch in the state that the operation lever 60 is at the position illustrated in FIG. 19. OP1 (RP1) indicates the switch in the state that the operation lever 60 is at the position illustrated in FIG. 20. OP2 (RP2) indicates the switch in the state that the operation lever 60 is at the position illustrated in FIG. 21. TTP indicates the switch in the state that the operation lever 60 is at the position illustrated in FIG. 22. The FP state illustrated in FIG. 19 indicates that the operation lever 60 is at the initial position (returning position).

Figure 19:
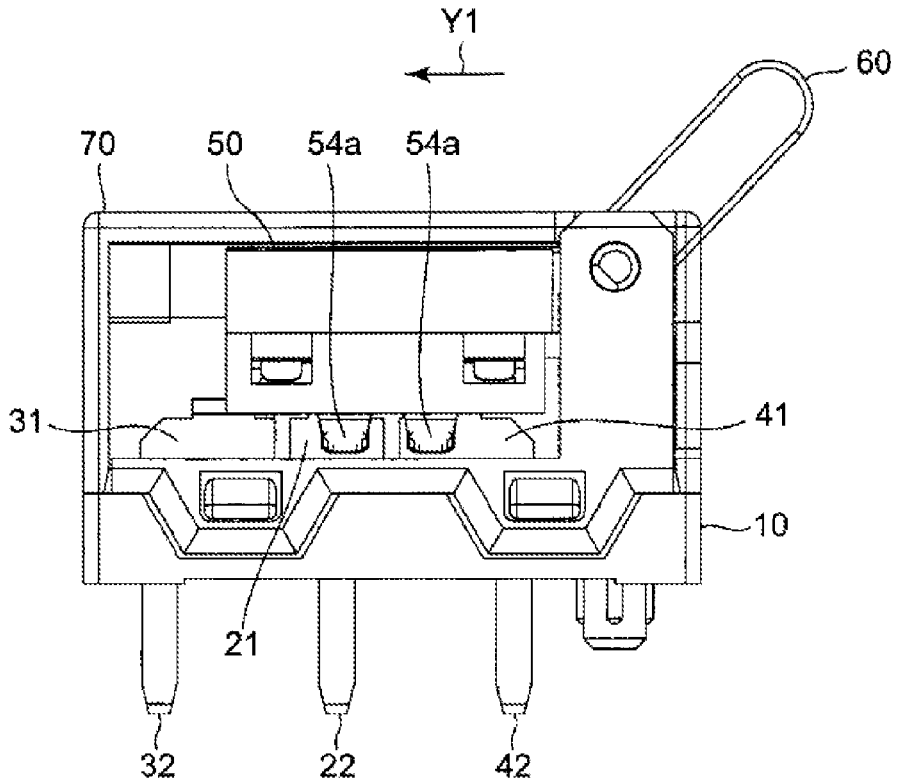
FIG. 19 is a perspective view of a side surface illustrating the switch in an FP state in FIG. 18.

First, when the operation lever 60 of the switch in the FP state illustrated in FIG. 19 is pressed down by pressing the operation lever 60, the sliding body 50 is pressed by the projection 65 of the pressing arm 62 of the operation lever 60. As a result, the movable contact 54*a* moves in the Y1 direction. In the FP state, the movable contact 54*a* touches the common fixed contact 21 and the second fixed contact 41, and keeps a conductive state between the common fixed contact 21 and the second fixed contact 41 of the switch parts SW1, SW2, and SW3.

Figure 20:
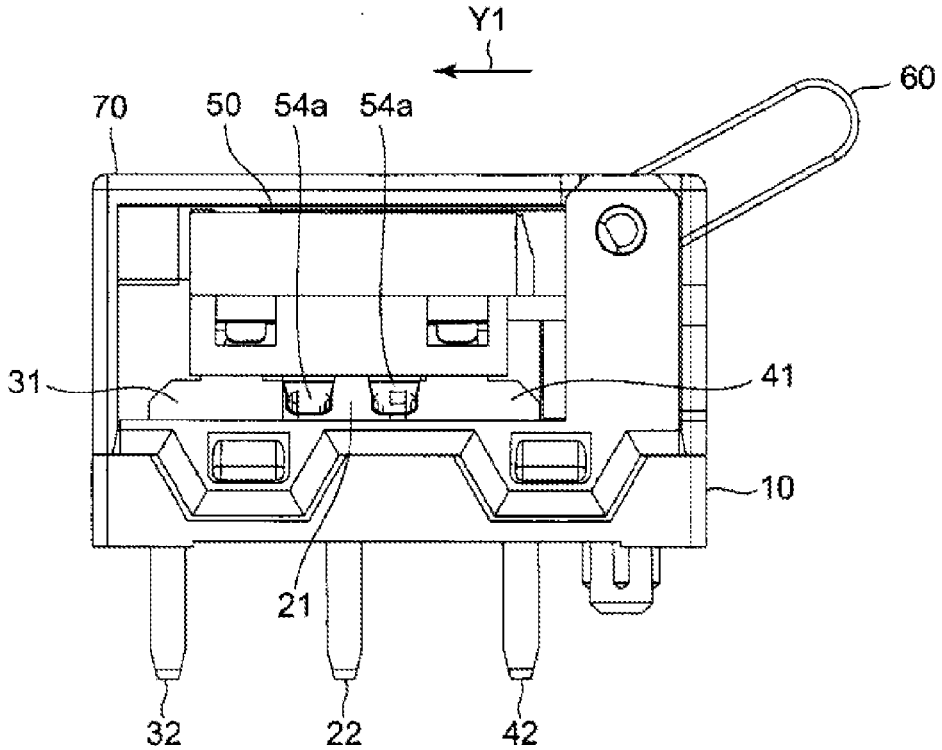
FIG. 20 is a perspective view of a side surface illustrating the switch in an OP1 (RP1) state in FIG. 18.

After the operation lever 60 is pressed down to the OP1 state illustrated in FIG. 20, the movable contact 54*a* is separated from the second fixed contact 41. As a result, the common fixed contact 21 and the second fixed contact 41 of the switch parts SW1, SW2, and SW3 become in the nonconductive state approximately at the same time. The movable contact 54*a* will never be separated from the common fixed contact 21.

Figure 21:
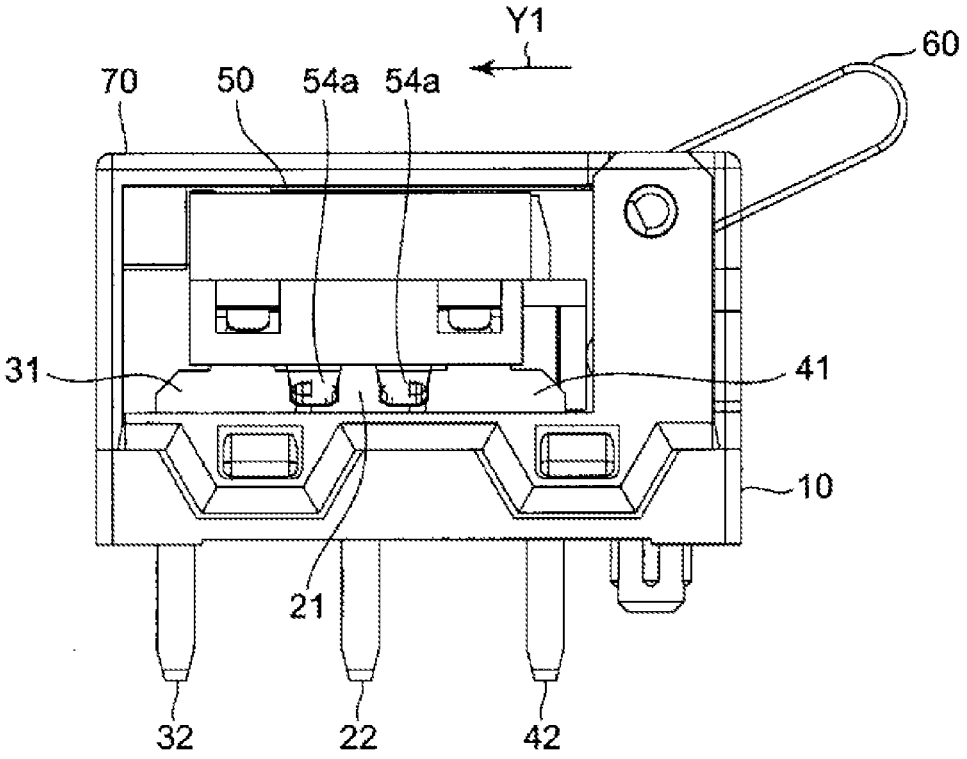
FIG. 21 is a perspective view of a side surface illustrating the switch in an OP2 (RP2) state in FIG. 18.

After the operation lever 60 reaches the OP2 state illustrated in FIG. 21 by further pressing down the operation lever 60, the movable contact 54*a* touches the common fixed contact 21 and the first fixed contact 31. As a result, the common fixed contact 21 and the first fixed contact 31 of the switch parts SW1, SW2, and SW3 become in the conductive state. At this time, high synchronism is required for making conductive the switch parts SW1, SW2, and SW3. Therefore, in the embodiment, as illustrated in FIG. 18, a moving distance of the sliding body 50 from when any one of the switch parts SW1, SW2, and SW3 becomes in the conductive state to when all the switch parts SW1, SW2, and SW3 become in the conductive state is configured to fall within 0.5 mm. Accordingly, a time difference between the switch part (SW2) that first becomes conductive and the switch part (SW3) that last becomes conductive can be set to fall within 1/100 second. As a result, the switch parts SW1, SW2, and SW3 that are three sets become conductive approximately at the same time.

Figure 22:
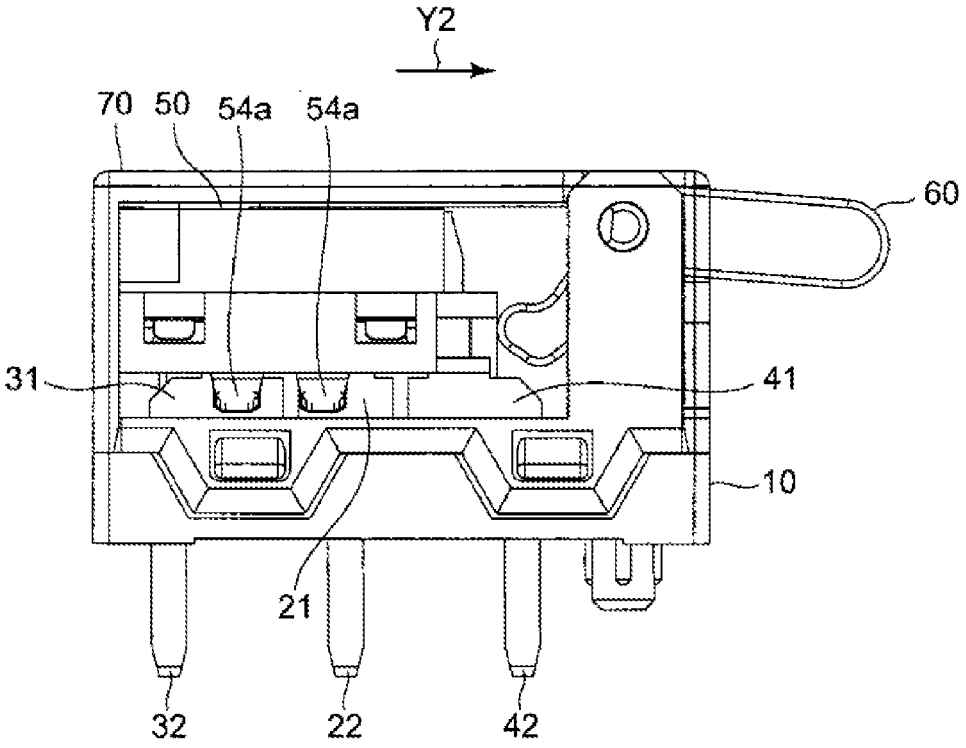
FIG. 22 is a perspective view of a side surface illustrating the switch in a TTP state in FIG. 18.

Thereafter, the operation lever 60 is pressed down to the TTP state illustrated in FIG. 22, and stops. Then, after the pressing of the operation lever 60 is cancelled, the sliding body 50 is pressed back to the Y2 direction by the elastic force of the coil spring 80. As a result, the operation lever 60 returns to the FP state illustrated in FIG. 19 via the RP2 state illustrated in FIG. 21 and the RP1 state illustrated in FIG. 20.

In the switch, the common terminal hole 11*a* and the first and second terminal holes 11*b* and 11*c* in each terminal hole row 11 are disposed at an equal interval. The interval between the common fixed contact terminal 20 and the first fixed contact terminal 30 and the interval between the common fixed contact terminal 20 and the second fixed contact terminal 40 are configured to be equal. However, the interval is not limited to this configuration. The interval may be suitably set according to the design of the switch and the like.

Furthermore, although the switch parts SW1, SW2, and SW3 that are three sets are set in the base 10, the number of the set is not limited to three. When possible, the switch part may be in one set or two sets, or may be in four or more sets.

The angle formed by the lever body 61 and the pressing arm 62 of the operation lever 60 may be any angle so far as the pressing portion 76 of the cover 70 can press the pressing arm 62 at the time of assembling the switch. The angle can be suitably changed by the design of the switch and the like.

INDUSTRIAL APPLICABILITY

The present invention can be also applied to a switch of other mode, as well as the above switch.

DESCRIPTION OF SYMBOLS

10 base
11 terminal hole row
11*a* common terminal hole
11*b* first terminal hole
11*c* second terminal hole
12 guide groove
13 support
14 supporting hole

15 mounting groove
16 positioning protrusion
17 flux-preventing recess
18 mounting projection
19 positioning projection
20 common fixed contact terminal
21 common fixed contact
22 common fixed terminal
30 first fixed contact terminal
31 first fixed contact
32 first fixed terminal
40 second fixed contact terminal
41 second fixed contact
42 second fixed terminal
50 sliding body
51 body part
52 coil spring housing
53 guide projection
53*a* latching portion
54 movable touch piece
54*a* conducting part
54*b* latching portion
55 projection
56 fitting groove
57 pressing wall
58 holding protrusion
58*a* latching hole
59 pressing projection
60 operation lever
61 lever body
62 pressing arm
63 shaft
64 pressing plane
65 projection
66 pressing groove
70 cover
71 supporting rib
72 mounting hole
73 operation hole
74 notch
75 supporting hole
76 pressing portion
80 coil spring

The invention claimed is:

1. A switch comprising:

a base;

a plurality of fixed contact terminals of which fixed contacts are stretched at an interval so as to form at least one row, on an upper surface of the base;

a sliding body comprising a movable touch piece for making adjacent ones of the fixed contacts conductive, and slidably disposed along the row of the fixed contact terminals, on an upper surface of the base;

an operation lever turnably supported on the upper surface of the base, and configured to press the sliding body to cause the sliding body to slide;

a coil spring assembled to the sliding body, and configured to bias the sliding body to return toward the operation lever when the sliding body is moved by the operation lever; and a cover comprising an operation hole for operating the operation lever and a pressing portion for pressing the operation lever, and configured to cover the base, wherein the fixed contact terminal, the sliding body, the operation lever, and the coil spring are mounted to the base from above the base, and the sliding body is pressed against the operation lever to position the operation lever, and the cover is mounted to the base from above so as to press the operation lever by the pressing portion of the cover and cause the operation lever to rotate to an initial position.

2. The switch according to claim 1, wherein the operation lever comprises a lever body turnably supported on the base, and a pressing arm extending so as to form a certain angle with the lever body and configured to press the sliding body to cause the sliding body to slide, and the cover is mounted to the base from above so as to press the pressing arm with the pressing portion.

3. The switch according to claim 2, wherein the operation lever comprises, on at least a part of a surrounding of a turning axis of the lever body, a curved surface on which the operation lever can turn by keeping a pressure contact with the sliding body.

4. The switch according to claim 3, wherein the sliding body comprises a pressing projection comprising a tapered surface which becomes in pressure contact when the tapered surface is pressed against the operation lever.

5. The switch according to claim 1, wherein a coil spring housing for housing the coil spring is provided on an upper part of the sliding body, and the coil spring housing comprises an opened box shape.

6. The switch according to claim 1, wherein a supporting rib is protruded on an inner surface of the cover, the supporting rib being configured to be brought into pressure contact with one end of the coil spring to compress the coil spring, for obtaining a returning force for causing the sliding body to return toward the operation lever.

7. The switch according to claim 6, wherein the supporting rib and the coil spring is brought into contact with each other when, by mounting the cover to the base from above, the lower surface of the supporting rib is at a position above the upper surface of the coil spring by ⅓ or more of the diameter of the coil spring.

* * * * *